United States Patent [19]

Buiguez et al.

[11] Patent Number: 4,924,643

[45] Date of Patent: May 15, 1990

[54] METHOD AND APPARATUS FOR THE TREATMENT OF WORK PIECES BY SHOT BLASTING

[75] Inventors: Alexandre Buiguez, Aubagne; Claude Gibot, Malakoff, both of France

[73] Assignee: Carboxyque Francaise, Puteaux, France

[21] Appl. No.: 307,128

[22] Filed: Feb. 3, 1989

[30] Foreign Application Priority Data

Feb. 12, 1988 [FR] France ..... 8801 694

[51] Int. Cl.[5] ..... B08B 7/00

[52] U.S. Cl. ..... 51/320; 51/322; 51/436; 51/437; 51/439

[58] Field of Search ..... 51/410, 320, 321, 322, 51/424, 436, 437, 439

[56] References Cited

U.S. PATENT DOCUMENTS 4,478,368 10/1984 Yie .
4,555,872 12/1985 Yie ..... 51/320
4,655,847 4/1987 Ichinoseki ..... 51/410
4,773,189 9/1988 Macmillan ..... 51/410

FOREIGN PATENT DOCUMENTS 0234365 9/1987 European Pat. Off. .
2638323 3/1978 Fed. Rep. of Germany .
2724318 11/1978 Fed. Rep. of Germany ..... 51/437
999800 2/1952 France .
2285961 4/1976 France .
2576821 8/1986 France .
1075300 4/1986 Japan ..... 51/320

*Primary Examiner*—Frederick R. Schmidt
*Assistant Examiner*—Blynn Shideler
*Attorney, Agent, or Firm*—Young & Thompson

[57] ABSTRACT

Particles of shot and particles of carbon dioxide ice are simultaneously blasted onto the work piece (6) to be treated. Application in the treatment of the surface of work pieces composed of plastics material or coated with a plastics material.

2 Claims, 1 Drawing Sheet

METHOD AND APPARATUS FOR THE TREATMENT OF WORK PIECES BY SHOT BLASTING

Figures 1, 2:
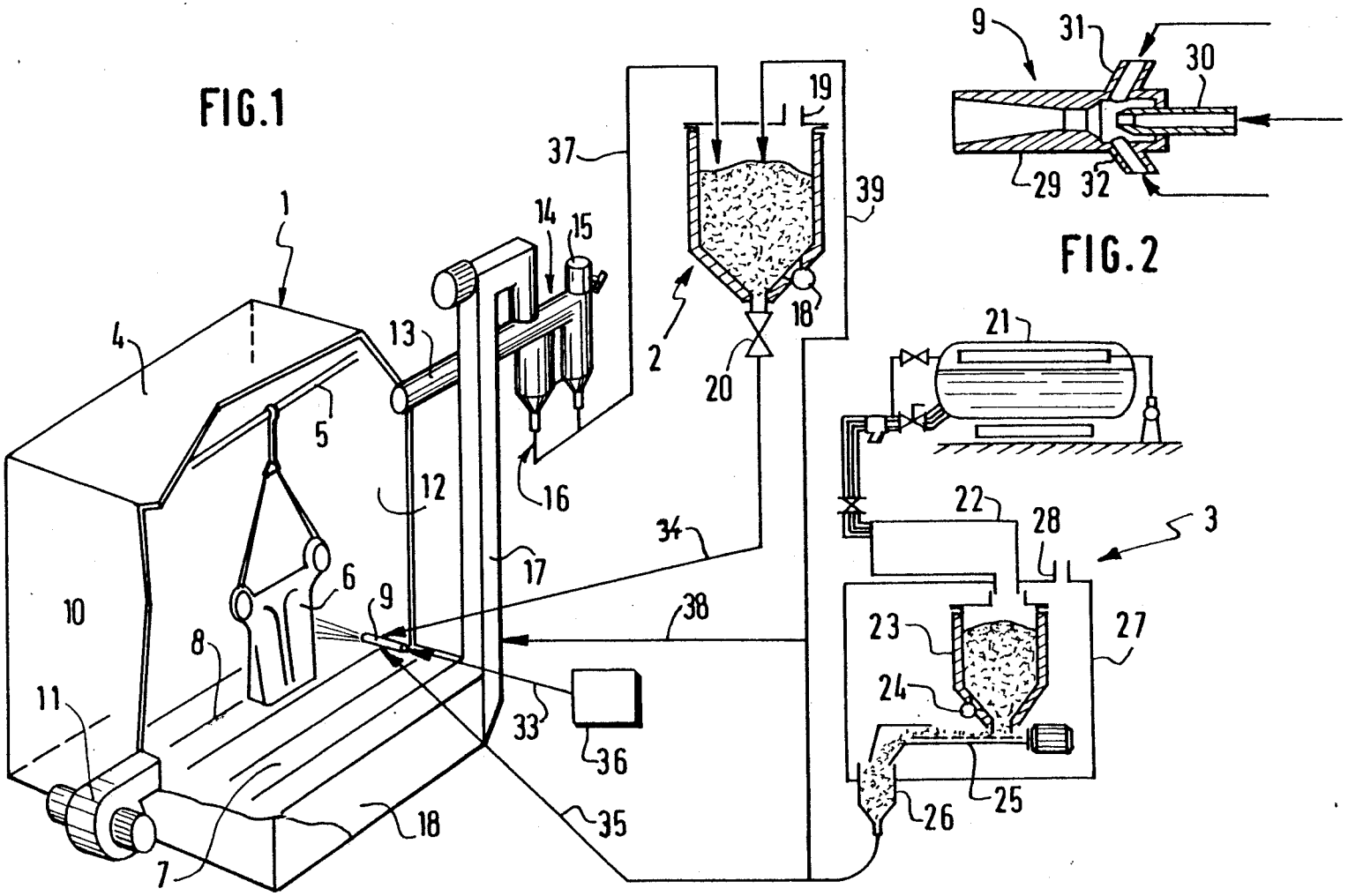

The present invention relates to the treatment of work pieces, in particular the fettling or scouring thereof, by the simultaneous blasting of shot and particles of carbon dioxide ice. It utilizes an installation for the treatment of work pieces by the simultaneous blasting of shot and particles of carbon dioxide ice of the type comprising:

a hopper for storing the shot;

means for producing particles of carbon dioxide ice;

means for simultaneously blasting shot and carbon dioxide ice including a source of carrier gas under pressure.

The invention in particular applies to the treatment of work pieces composed of or covered with a plastics material. "Shot" is intended to mean particles solid at ambient temperature, such as particles of metal or plastics material.

The shot treatment of plastics materials of the PVC, epoxy resins type, etc., presents serious problems owing to the following phenomena: the rebound of the shot on the plastics material without achieving the desired mechanical impact; heating of the plastics material; adherence of dust on the plastics material owing to the presence of static electricity.

In order to avoid these drawbacks, it has been proposed (FR-A-2,576,821) to blow particles of carbon dioxide ice onto the work pieces. However, this method is limited to certain applications owing to the high cost and prolonged treatment times required, the carbon dioxide ice being much less effective than the conventional shot.

Furthermore, the document DE-A-26 38 323 proposes, in certain particular cases, the simultaneous blasting of shot and particles of carbon dioxide ice by means of an installation of the aforementioned type, but the blasting of pre-mixed particles described therein results in serious technological difficulties in the control of the blasting rates.

An object of the invention is to provide an effective and economical method for treating plastics materials.

The invention therefore provides a method and an installation of the aforementioned type, wherein the blasting means comprise a blasting nozzle including three inlets respectively connected to said storing means, to the producing means and to said source. An embodiment of the invention will now be described with reference to the accompanying drawing, in which:

FIG. 1 is a diagrammatic view of an installation for practicing a method according to the invention, and FIG. 2 is a sectional view of the blasting nozzle of this installation. The installation shown in FIG. 1 mainly comprises a shot-blasting cabin 1, a hopper 2 for storing shot and an apparatus 3 for producing particles of carbon dioxide ice.

The cabin 1 comprises a case 4 equipped with a support 5 from which a workpiece 6 to be treated is suspended. The floor 7 of this case is provided with shot recovering slots 8. A blasting nozzle 9 employing the Giffard effect, which will be described hereinafter, extends through a lateral wall of the case. It may concern in particular a single nozzle handled manually. Extending through another lateral wall 10 of the case is the delivery duct of a blower 11 which blows in ambient air; the lateral wall 12 opposed to the wall 11 is provided with a discharge duct 13 communicating with a gas-solid separator 14 which has an adjustable vent 15 provided with a filter and a double outlet 16 for the separated solid particles. An elevator 17, for example of the screw type, extends from a collector 18 located under the floor 7 of the case to the separator 14.

The hopper 2 is heat-insulated and provided with a vibrator 18, a vent 19 and a metering outlet valve 20.

The apparatus 3 is of the type described in the aforementioned patent application FR-A-2,576,821. It comprises a storage tank 21 of $CO_2$(carbon dioxide) which is liquid at −20° C., 20 bars feeding a device 22 producing particles of carbon dioxide ice, which comprises a pellet producing device feeding pellets to a crusher producing small blocks or rods ("pellets") of carbon dioxide ice. The device 22 gravity-feeds the crushed particles, for example having a particle size of 1 to 4 mm and an angular shape, to a heat-insulated hopper 23 provided with a vibrator 24. The outlet of this hopper gravity-feeds the particles to a screw extractor 25 which in turn delivers a metered flow of particles to an outlet funnel 26.

The elements 22, 23, 25 and 26 are spaced apart and a cover 27 provided at the top with a vent 28 surrounds all the parts of the apparatus 3 where the particles of carbon dioxide ice are exposed to the surrounding atmosphere, namely the outlet of the device 22, the hopper 23, the extractor 25, and the inlet of the funnel 26. Thus, after cooling the apparatus 3, in the course of which the sublimation of the carbon dioxide ice gives off dry gaseous $CO_2$ which is heavier than air and gradually fills the cover 27, the particles of carbon dioxide ice are maintained under an atmosphere of dry $CO_2$ under a pressure in the neighbourhood of atmospheric pressure, which precludes any penetration of humidity within these particles and avoids their agglomeration.

The nozzle 9 (FIG. 2) comprises a tubular body defining two parts: a front prt 29 having a convergent-divergent shape constituting a venturi, and a rear part constituting a chamber onto which open three conduits: an axial conduit 30 and two lateral conduits 31, 32. Each of the two lateral conduits penetrates the body of the nozzle obliquely and is orientated forwardly toward a point on the axis of this body located a little in front of the outlet orifice of the axial conduit 30.

The various elements of the installation described hereinbefore are interconnected in the following manner:

conduits 33 to 35 respectively connect the inlets 30 to 32 of the nozzle 9 to a source 36 of carrier gas under pressure, for example compressed air at a mean pressure of between 4 and 7 bars, to the outlet of the hopper 2 storing the shot and to the outlet of the funnel 26;

a conduit 37 connects the outlet 16 of the separator 14 to the top of the hopper 2;

and conduits 38 and 39 respectively connect the outlet of the funnel 26 to the lower part of the elevator 17 and to the top of the hopper 2.

In operation, the stream of carrier gas travelling at high velocity and issuing from the conduit 30 draws in both shot from the hopper 2 and particles of carbon dioxide ice from the funnel 26. The particles of carbon dioxide ice in this way perform a triple function: they cool the shot before the latter reaches the workpiece 6; they create a cooling of the work piece and possibly render the workpiece fragile, which enables the shot to act effectively thereon; and they produce an appreciable abrasive effect themselves.

The renewal of air ensured by the blower 11 avoids the cooling of the cabin 1 and the occurrence of condensation of humidity. Moreover, the supply of carbon dioxide ice in the elevator 17 and in the hopper 2 permits the pre-cooling of the shot during its storage, which serves the same purpose as the mixture of the shot with the carbon dioxide ice in the nozzle 9.

As a variant, the carrier gas may be $CO_2$ under pressure. Furthermore, for non-permanent installations, the unit producing "pellets" may be replaced by a simple reservoir storing carbon dioxide ice rods which directly feeds the crusher of the apparatus 3.

As a further variant, the carbon dioxide ice and the shot may be blown by two separate nozzles directed toward a common point of impact on the work piece 6. In this case, the blasting nozzle for the carbon dioxide ice is a nozzle employing the Giffard effect, i.e. similar to the nozzle 9 but having a single lateral inlet, whereas the other nozzle may be of the type employing the Giffard effect or a nozzle blasting shot under pressure. In the latter case, there is for example employed a hermetic hopper for storing the shot which is periodically connected to the surrounding air for receiving a charge of recycled shot and a charge of carbon dioxide ice, which, after closing the hopper, results in its repressurization by sublimation.

We claim:

1. A method for treating workpieces by simultaneous blasting of shot which is permanently solid at ambient temperature and particles of carbon dioxide ice, comprising feeding said shot to one lateral inlet of a nozzle having an axial inlet and two lateral inlets converging axially and an axial outlet of the convergent-divergent kind, feeding dry carbon dioxide ice particles to the other said lateral inlet, feeding a carrier gas to said axial inlet to provide a high velocity stream carrying both said shot and said ice particles, directing said high velocity stream against a said workpiece, thereafter recovering said shot and a portion of said carbon dioxide particles, cooling said recovered shot with additional carbon dioxide particles, and recycling said cooled recovered shot to said one inlet.

2. Apparatus for treating workpieces by a simultaneous blasting of shot which is permanently solid at ambient temperature and particles of carbon dioxide ice, comprising a hopper for storing the shot, means for producing dry particles of carbon dioxide ice, another hopper for storing said carbon dioxide particles in dry condition, a nozzle having two lateral inlets and an axial inlet, means for conveying shot from said shop hopper to one said lateral inlet of said nozzle, means for conveying carbon dioxide particles from said another hopper to the other said lateral inlet of said nozzle, means to supply gas under pressure to said axial inlet of said nozzle, thereby to produce a high velocity stream carrying both shot and ice particles, a cabin for enclosing a workpiece against which said high velocity stream is directed, means for recovering from said cabin said shot and part of said carbon dioxide particles, means for returning said recovered shot to said shot hopper thereby to recycle said shot, and means for cooling said recovered shot with additional carbon dioxide particles prior to the feeding of the recycled shot to said nozzle.

* * * * *